US007018006B1

(12) United States Patent
Tezak

(10) Patent No.: US 7,018,006 B1
(45) Date of Patent: Mar. 28, 2006

(54) SHELVING UNIT FORMED FROM A VEHICLE TIRE

(76) Inventor: Theodore Kennith Tezak, #10 Main St., P.O. Box 202, Taylor, WI (US) 54659

( * ) Notice: Subject to any disclaimer, the term of this patent is extended or adjusted under 35 U.S.C. 154(b) by 38 days.

(21) Appl. No.: 10/607,651

(22) Filed: Jun. 27, 2003

(51) Int. Cl.
*A47F 3/00* (2006.01)

(52) U.S. Cl. ..... 312/114; 312/204

(58) Field of Classification Search ..... 312/204, 312/224, 225, 245, 223.5, 138.1, 114, 351; 108/23, 50.11; 224/42.13; D6/559, 563
See application file for complete search history.

(56) References Cited

U.S. PATENT DOCUMENTS

| | | | | | |
|---|---|---|---|---|---|
| 1,874,776 | A | * | 8/1932 | Martin | 312/101 |
| D171,870 | S | * | 3/1954 | Stert | D6/563 |
| 2,703,743 | A | * | 3/1955 | Harwood | 312/128 |
| 3,963,287 | A | * | 6/1976 | Rumble | 312/197 |
| D292,053 | S | * | 9/1987 | Spurling et al. | D6/514 |
| D304,792 | S | * | 11/1989 | Baus | D6/559 |
| 5,203,479 | A | * | 4/1993 | Lucas | 224/42.13 |
| D337,009 | S | | 7/1993 | Downing | |
| D353,495 | S | | 12/1994 | Tan | |
| D376,286 | S | * | 12/1996 | Duarte | D6/559 |
| 5,706,991 | A | * | 1/1998 | Stewart | 224/539 |
| D394,517 | S | | 5/1998 | Gebhard, Sr. | |
| D418,014 | S | | 12/1999 | Schoelkopf et al. | |
| D439,682 | S | | 3/2001 | Murdick | |
| D445,778 | S | | 7/2001 | Eiler | |
| D450,861 | S | | 11/2001 | Murdick | |
| 6,394,001 | B1 | * | 5/2002 | Giesey et al. | 108/44 |
| 6,732,462 | B1 | * | 5/2004 | Kramer | 40/800 |

OTHER PUBLICATIONS

Asian Art Imports; at asianartimports.com; full wheel shelf ;Nov. 21, 2002.*

* cited by examiner

*Primary Examiner*—Janet M. Wilkens
(74) *Attorney, Agent, or Firm*—Craig A. Fieschko, Esq.; DeWitt Ross & Stevens, S.C.

(57) ABSTRACT

A shelving unit is formed from at least a portion of an entire vehicle tire (generally a used vehicle tire). Shelves are mounted within the interior of the tire section so that the lengths of the shelves extend within an arc of the tread surface, with the shelves being oriented at least substantially horizontally within the tire interior. The shelves may be mounted by affixing a panel to the tire section along the plane at which the tire is cut, and then affixing the shelves to the panel, whereby removal of all or a portion of the panel from the tire section also allows removal of the shelves. Such a panel may be hingedly affixed to the tire section to allow it to be swung open to allow a user access to the tire interior (and the shelves therein), or the panel may otherwise be made removable from the tire section to allow access. A transparent window may be provided across one (or both) of the hub/rim openings to allow a user to see any shelves within the tire section, while serving to protect any items on the shelves. Interior lighting of the tire section may also be provided to illuminate the shelves and any items thereon.

21 Claims, 2 Drawing Sheets

SHELVING UNIT FORMED FROM A VEHICLE TIRE

FIELD OF THE INVENTION

This disclosure concerns an invention relating generally to shelving.

BACKGROUND OF THE INVENTION

Common vehicle tires—for example, car, truck, and motorcycle tires—have a circumferential tread surface which rides along the ground, with sidewalls extending radially inwardly from the sides of the tread surface. The volume defined radially inwardly from the tread surface, and between the planes of the sidewalls, defines the tire interior wherein any tubes or other inflatable air-retaining chambers, and rims, hubs, and/or other connections to the vehicle, may be fit.

There are presently few uses for used vehicle tires. Since it is difficult to reprocess their constituent parts into virgin materials for manufacture of new tires or other items, tires are frequently recycled by simply grinding them, or otherwise reducing them to smaller parts, and then using these smaller parts as filler materials in building materials, composites, and other items. Otherwise, large sections of tires are sometimes used for playground equipment, shock-absorbing barriers along roadways, and breakwaters and dam components—but there are otherwise few common uses for large sections of tires. As a result, they are often landfilled, which is in the long term problematic because tires are not biodegradable; or alternatively, they may be incinerated, which is also problematic owing to the resulting soot, ash, and other waste products that are generated. It would therefore be valuable to devise other uses for vehicle tires which result in useful articles for consumers and/or industry, and which allow a reduction in the number of used tires in the waste stream.

SUMMARY OF THE INVENTION

The invention, which is defined by the claims set forth at the end of this document, is directed to a shelving unit made from a tire section which at least partially addresses the aforementioned problems. A basic understanding of some of the preferred features of the invention can be attained from a review of the following brief summary of the invention, with more details being provided elsewhere in this document.

A shelving unit is formed from a section of an entire vehicle tire (generally a used vehicle tire). Such vehicle tires are of the type well known for use on standard cars, trucks, motorcycles, and other vehicles, and they include an arcuate tread surface curving about a tire interior, and opposing sidewalls extending radially inwardly from the tread surface on opposing sides of the tire interior, with the sidewalls extending between the tread surface and a hub/rim opening. The tire section is formed from at least a portion of such an entire vehicle tire, and may be formed, for example, by cutting the vehicle tire in one or more planes (for example, by cutting the entire tire along a plane such that one of the sidewalls is removed, and/or by cutting the tire along a plane coincident with the tire's axis of rotation). Shelves are then mounted within the tire interior of the tire section so that the lengths of the shelves extend across an arc of the tread surface to rest at least substantially horizontally within the tire interior. The shelves may be mounted by affixing them directly to the tire section (i.e., by attaching them to the tread surface and/or sidewalls of the tire section), or if the tire section is formed by cutting an entire tire, by affixing a panel to the tire section along the plane at which the tire is cut, and then affixing the shelves to the panel, whereby removal of all or a portion of the panel from the tire section also allows removal of the shelves. Such a panel may be hingedly affixed to the tire section to allow it to be swung open to allow a user access to the tire interior (and the shelves therein), or the panel may otherwise be made removable from the tire section to allow access. A transparent window may be provided across one (or both) of the hub/rim openings to allow a user to see any shelves within the tire section, while serving to protect any items on the shelves. Interior lighting of the tire section may also be provided to illuminate the shelves and any items thereon.

Owing to its unique appearance, the shelving unit is particularly well-suited for aficionados of certain types of wheeled vehicles (for example, automobile or motorcycle buffs), racing fans, and vehicle technicians. These users might, for example, display awards, model vehicles, classic vehicle memorabilia, or racing gear in the shelving unit.

Further advantages, features, and objects of the invention will be apparent from the following detailed description of the invention in conjunction with the associated drawings.

DETAILED DESCRIPTION OF PREFERRED VERSIONS OF THE INVENTION

Figure 1:
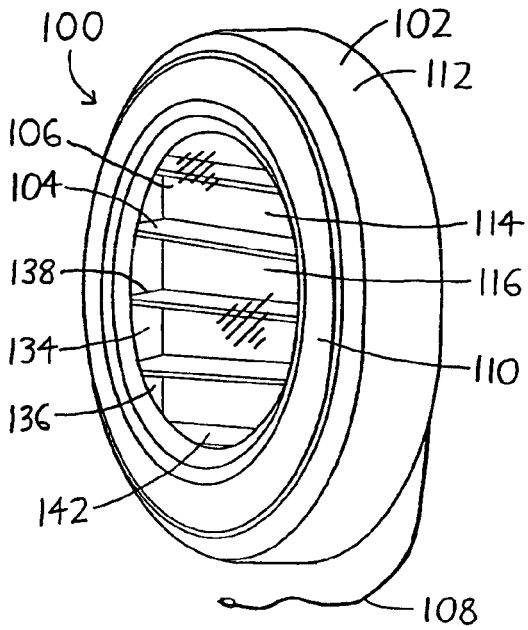
FIG. 1 is a front perspective view of a first version of the invention, showing the front of an exemplary shelving unit 100 and a portion of the surrounding circumferential tread surface 112.

Referring initially to FIGS. 1–4, a first exemplary version of the invention is designated generally by the reference numeral 100. Looking particularly to FIG. 1, the shelving unit 100 may be generally characterized as including a tire section 102 formed from a portion of a vehicle tire (e.g., a car or truck tire). The tire section 102 encloses and protects a number of shelves 104 mounted within the tire section 102, with an optional transparent front window 106 also protecting the shelves 104 and any items thereon. If internal lighting of the shelving unit 100 is desired, an electric cord 108 may lead from the exterior of the tire section 102 to its interior to power electric lighting situated therein. The shelving unit 100 and its components will now be discussed in greater detail.

Regarding the tire section 102, while it may assume a variety of shapes depending on how the intact vehicle tire is cut, in FIGS. 1–4 it includes one of the tire sidewalls 110 and approximately three-quarters of the tread surface 112 of the entire vehicle tire (with the intact tire not being shown). The remaining quarter of the tread surface 112 and the other sidewall 110 are cut from the intact tire along a plane parallel to the sidewalls 110 by use of a standard power saw, or even a hand-operated saw. When cutting the tire section 102, it is preferred that any protruding structures within the tire interior 114, such as tubes, hubs, rims, or other structures which are not formed or molded in direct connection with the tire section 100 be removed so that the hub/rim opening 116 opens directly onto the tire interior 114 (the space bounded by the tread surface 112, and between the planes of the sidewalls 110, of the intact vehicle tire).

Figure 2:
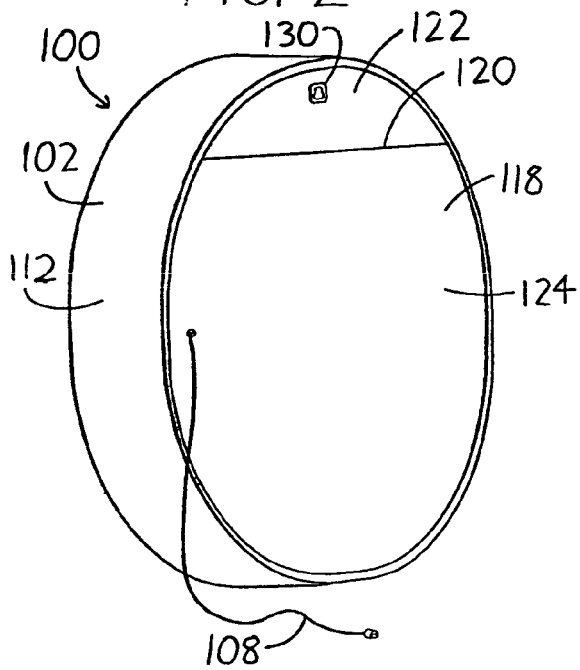
FIG. 2 is a rear perspective view of the shelving unit 100 of FIG. 1, showing the rear of the shelving unit 100 and a portion of the surrounding circumferential tread surface 112.
Figure 3:
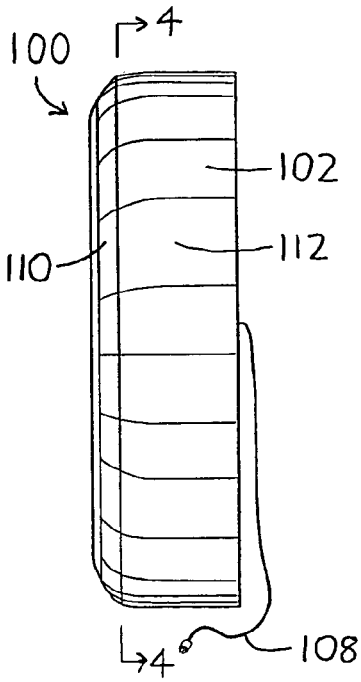
FIG. 3 is a side view of the shelving unit 100 of FIGS. 1 and 2, showing the tread surface 112 extending between the front sidewall 110 and rear of the shelving unit 100.

Referring then particularly to FIG. 2, and also to the views of FIGS. 1 and 4, a back panel 118 extends across the tire section 102 at the plane where the tire section 102 was cut from the intact vehicle tire (this plane hereinafter being referred to as the "cut plane"). The back panel 118 is preferably formed of a sheet of plywood which is sized to fit just within the tire interior 114 adjacent the cut plane, with the bounding sides of the back panel 118 closely fitting against the inner circumference of the tire section 102 so that the back panel 118 effectively closes the tire section 102 along its cut plane. The back panel 118 is formed in two parts separated by a joint 120: a fixed portion 122 is preferably affixed to the inner circumference of the tread surface 112 by fasteners such as staples or nails (not shown) or by adhesives, and a removable portion 124 is attached to the fixed portion 122 by a hinge 126 (shown in FIG. 4 within the tire interior 114, though the hinge 126 may be externally mounted instead). The removable portion 124 may therefore be lifted outwardly from the tire interior 114 by swinging it about the hinge 126 at the joint 120, allowing a user to access the tire interior 114. The removable portion 124 may be firmly held in place about the border of the tire interior 114 by providing some means for latching the removable portion 124 with respect to the tread surface 112; for example, referring to FIG. 4, a wooden block 128 may simply be situated at the bottom edge of the removable portion 124 so that it will rest adjacent the tread surface 112 when the removable portion 124 is swung shut, and a fastener (not shown) may be driven through the tread surface 112 and into the block 128 to affix the removable portion 124 in place with respect to the tread surface 112. Alternatively, the means for latching the removable portion 124 closed, if such a latching means is included, might instead be formed of standard cabinetry latches or the like. Referring to FIG. 2, a conventional hanging socket 130 or other hanging hardware may be provided on the fixed portion 122 to allow the shelving unit 100 to be hung from a wall if desired.

Figure 4:
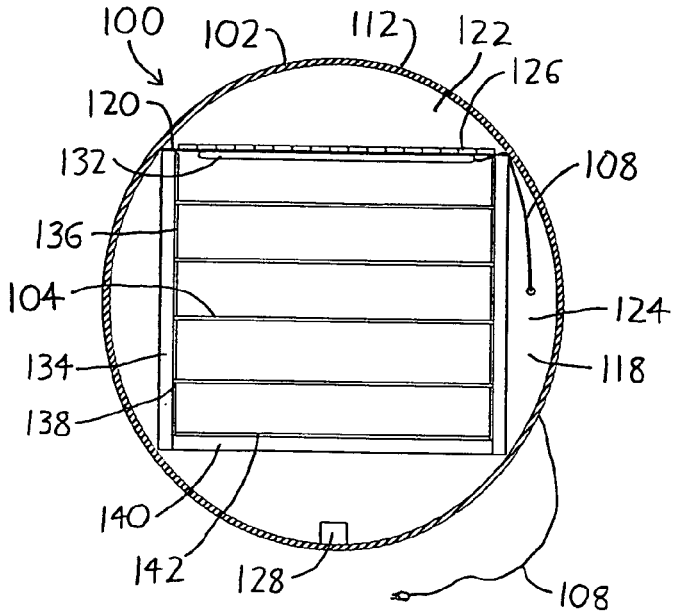
FIG. 4 is a front elevational view of a cross-section of the shelving unit 100 of FIGS. 1–3, shown from the plane 4—4 in FIG. 3 and thereby showing the interior 114 of the shelving unit 100 as it would appear if its front sidewall 110 was removed.

Looking then particularly to the cutaway view of FIG. 4, which shows the shelves 104 from the tire interior 114, a light 132 may be provided within the tire interior 114 if illumination of the shelves 104 is desired. The light 132 is here depicted as a length of rope lighting, though any other type of common light source is suitable as well. The light 132 may be provided at any number of different locations within the tire interior 114, and here it is shown below the hinge 126 on the removable portion 124 of the back panel 118 (though it could be provided on the fixed portion 122 of the back panel 118 instead, or on the inner circumference of the tire section 102). Since the interior surface of the tire section 102 will usually be quite dark, and will readily absorb light, it can be useful to cover the interior surface of the tire section 102 with a white (or other light-colored) paint, or with a reflective paint or coating (e.g., foil), to increase its reflectivity.

The shelves 104 are then preferably affixed to the removable portion 124 of the back panel 118 below the light 132, so that the shelves 104 will pivot with the removable portion 124 when it is opened about its joint 120. The shelves 104 of the shelving unit 100 are preferably made of transparent material such as glass, or more preferably a transparent plastic such as polycarbonate (which is less susceptible to breakage), to better allow light transmission throughout the shelves 104 and the tire interior 114 (which can otherwise be quite dark). The shelves 104 are mounted to the back panel 118 between shelf sidewalls 134, which may simply be made of planks of wood which are affixed to the back panel 118 by fasteners such as nails or staples (not shown), or by adhesive. The shelf sidewalls 134 preferably bear mirror tiles 136 which are slightly spaced apart to define slots 138, into which the shelves 104 are fit. For further rigidity, a bridge member 140—which may also be formed of a plank of wood—may be affixed between the shelf sidewalls 134 and to the back panel 118. The bridge member 140, which effectively defines the lowermost shelf 104, need not be formed of transparent material (as the other shelves 104 preferably are). Instead, it is preferred that a mirror 142 be provided on the top surface of the bridge member 140. By forming the majority of the shelves 104 of transparent materials, and by largely surrounding the shelves 104 with mirrors by providing mirrored surfaces 136 and 142 on the sidewalls 134 and the bridge member 140, the light 132 shining downwardly through the shelves 104 and reflecting from the mirrors 136 and 142 will brightly illuminate the portion of the tire interior 114 defined between the shelf sidewalls 134 and the bridge member 140. As can be seen best in FIG. 1, the shelf sidewalls 134 (and the bridge member 140) are situated just outside the hub/rim opening 116 so that they are not visible to a viewer from outside of the shelving unit 100, though the shelves 104 are plainly visible to viewers.

The foregoing arrangement allows a user to swing back the removable portion 124 (or swing forward the tire section 102) to open the shelving unit 100, load the shelves with items to be displayed, and then close (and possibly latch) the shelving unit 100. The shelving unit 100 may then be hung on a wall or otherwise situated for viewing, and may be illuminated if a light 132 is included.

It should be kept in mind that the shelving unit 100 depicted in FIGS. 1–4 is merely an exemplary preferred version of the invention, and modified versions of the shelving unit 100 can still infringe the claims set forth at the end of this document. Following is a discussion of several exemplary modifications that can be made.

Figure 5:
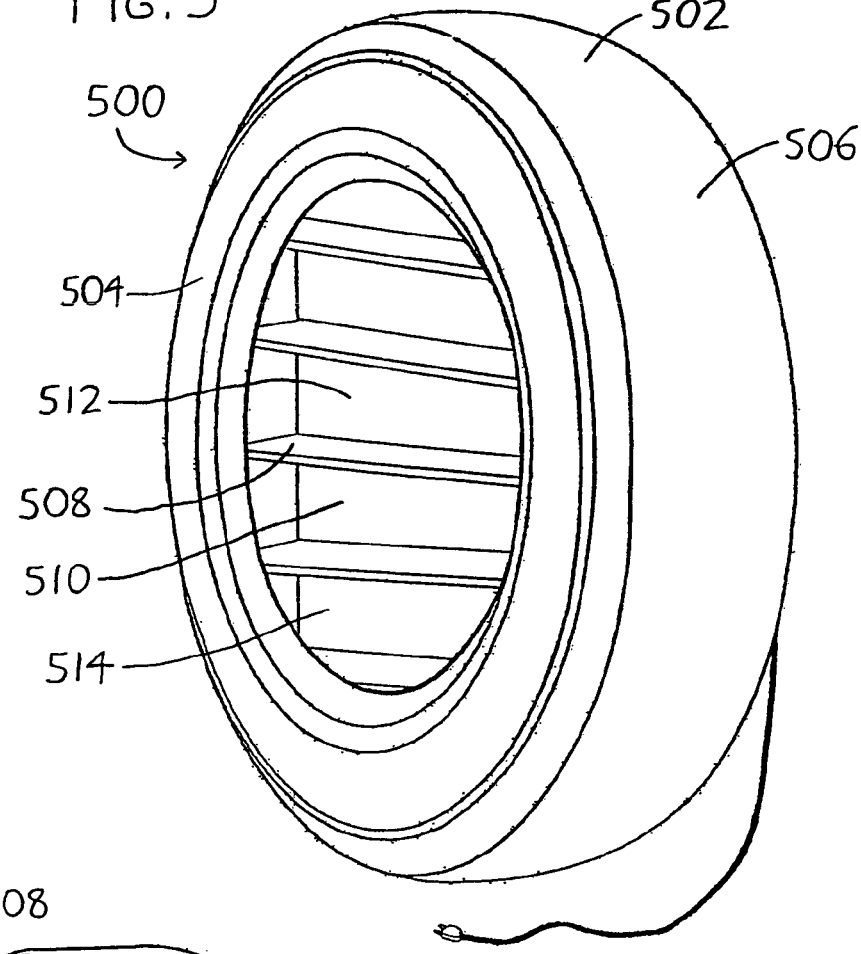
FIG. 5 is a front perspective view of a second version of the invention, showing the front of a shelving unit 500 and a portion of its surrounding circumferential tread surface 506.

Initially, shelving units in accordance with the invention need not be formed of tire sections cut as in the shelving unit 100, and in fact tire sections need not be cut at all. FIG. 5 illustrates a second exemplary version of the invention wherein a shelving unit 500 is formed of a tire section 502 consisting of essentially an entire intact tire, including both of its opposing sidewalls 504 (only one of which is shown in FIG. 5) and the entirety of its tread surface 506. Its shelves 508 are situated on a back panel 510 which is located between the sidewalls 504 within the tire interior 512 (and affixed to the rear sidewall, which is not directly visible in FIG. 5). In this case, since both sidewalls 504 are present, access to the tire interior 512 is made more difficult, and the shelves 508 and back panel 510 may need to be inserted within the hub/rim opening 514—perhaps after flexing/bending the tire section 502 to increase the size of the hub/rim opening 514- and the shelves 508 and back panel 510 may need to be assembled in place within the tire interior 512. Another alternative is to take shelves such as the shelves 104 in FIG. 4, along with their associated sidewalls 134 and bridge member 140 (but perhaps lacking the back panel 510), and cut notches in one of the sidewalls 504 in such a way that the assembled shelves 104 may have their corners slid through the notches so that the shelves 104 may be fit into the tire interior 512. Once within the tire interior 512, the shelves 104 and their associated components can be rotated within the tire interior 512 (e.g., by 45°) and may be affixed to the sidewalls 504.

Figure 6:
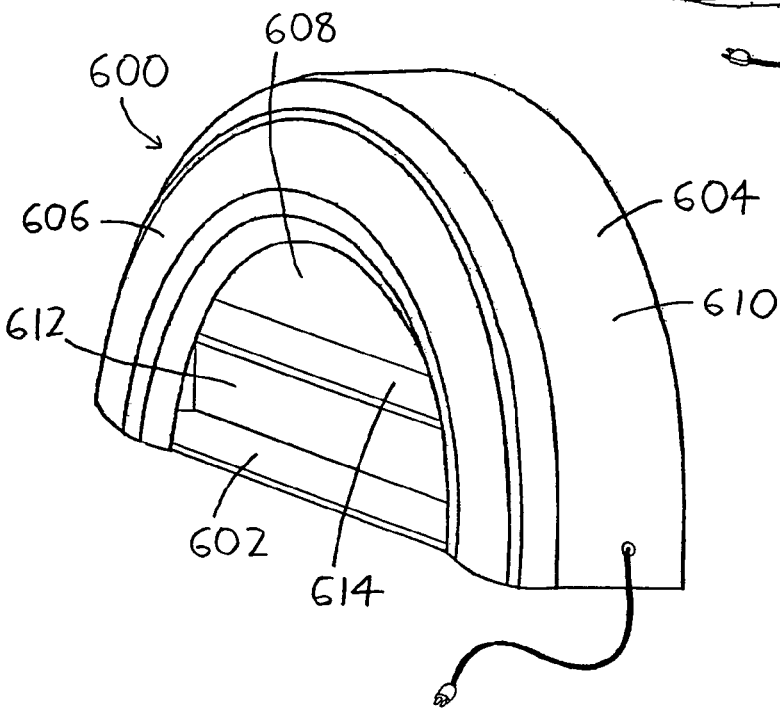
FIG. 6 is a front perspective view of a third version of the invention, showing the front of a shelving unit 600 and a portion of its surrounding circumferential tread surface 610.

FIG. 6 then illustrates another exemplary version of the invention wherein a shelving unit 600 is formed with a flat bottom panel 602, which also allows the shelving unit 600 to serve as a bookend, pedestal, or other structure. The tire section 604 of the shelving unit 600 is formed by cutting an intact vehicle tire, first in a cut plane parallel to the sidewalls 606 (as with the tire section 102 of the shelving unit 100), and then in a cut plane coincident with the tire's axis of rotation. A bottom panel 602 may then be formed which fits within the tire interior 608 across one of the cut planes to have its ends fit complementarily in close abutment with the inner surfaces of the sidewalls 606 and tread surface 610. Similarly, a back panel 612 can be provided across the arc of the tread surface 610 to close the tire interior 608 adjacent the other cut plane. Conveniently, the back panel 612 may in this case be hingedly affixed directly to the bottom panel 602 (with the hinge not being shown in FIG. 6). The shelves 614 may simply be cut to fit complementarily within the tire interior 608 to be affixed to the tread surface 610 and/or sidewalls 606 of the tire section 604, and/or the shelves 614 may be affixed to the back panel 612.

It should therefore be apparent from the foregoing examples that the tire used to form the tire section of the invention may be cut along a variety of differently located planes, or need not be cut at all. Other modifications to the invention are also possible as well.

First, the invention can be made far more complex (with additional lights or other electronics, multiple removable portions, etc.), or it can be made as simple as a tire section having shelves affixed directly to the sidewalls and/or tread surface, with no front window 106, back panel 118, or other structure.

Second, tires having a wide variety of configurations different from the ones depicted in the drawings may be used to implement the invention. The tread surface is depicted throughout the drawings as lacking treads (i.e., lacking the ribs and grooves commonly used to increase traction), though it should be understood that treads may be present on the tread surface 112. Additionally, no insignia (e.g., brand names) are illustrated on the tire sections illustrated in the drawings, but it is expected that such insignia will often be present.

Third, many arrangements can be made for at least partially enclosing the tire section, and allowing access to the tire interior, apart from the arrangements noted above. As an example, rather than providing the back panel 118 with a fixed portion 122 attached to the tire section 102, and a removable portion 124 hinged to the fixed portion 122, the back panel 118 might be formed as a single piece which is removably affixed to the tire section 102, and which might (perhaps in conjunction with the shelves 104) be removed from the tire section 102 when access to its interior is desired, and replaced for use and display. It is also possible that a back panel or other panel may not be included at all.

Fourth, the shelves might be formed as separate units (or as a single separate unit) from any panels used to enclose the tire section. For example, in the shelving unit 100, it is also possible to affix the shelves 104 to the tire section 102 and simply provide the back panel 118 as a door or removable hatch allowing access to the shelves 104 and the tire interior 114.

Fifth, while certain materials were noted as being preferred for use for the various components of the shelving units described above (e.g., plywood for the back panel 118), other materials and combinations of materials are possible. As an example, in the shelving unit 600, the bottom panel 602, back panel 612, and shelves 614 may be formed of molded plastic as an insert which simply slips into the tire section 604 to complete the assembly of the shelving unit 600.

Sixth, if lighting is included, it may be included externally instead of (or addition to) internally, and may be powered by batteries or other means other than by an electrical cord.

The foregoing modifications are merely examples of the many modifications that may be made to the invention, and other modifications are possible as well. It is therefore emphasized that the invention is not intended to be limited to the preferred versions of the shelving unit described above, but rather is intended to be limited only by the claims set out below. Thus, the invention encompasses all different versions of the shelving unit that fall literally or equivalently within the scope of these claims.

What is claimed is:

1. A shelving unit comprising:

a. at least a section of a vehicle tire, including a tread surface curving about a tire interior;

b. shelves mounted within the section of the vehicle tire within the tire interior, the shelves having lengths extending within an arc of the tread surface, wherein the shelves are pivotally affixed with respect to the tread surface, and thereby pivotable out of the tire interior.

2. The shelving unit of claim 1 comprising a back panel extending across an arc of the tread surface, and wherein a. a tire sidewall extends inwardly from the tread surface, and b. the back panel is spaced from the tire sidewall, with the tread surface extending between the tire sidewall and the back panel.

3. The shelving unit of claim 1 further comprising a back panel extending across an arc of the tread surface, and wherein the shelves are affixed to the back panel.

4. The shelving unit of claim 3 wherein the back panel includes;

a. a fixed portion affixed to the tread surface, and b. a removable portion pivotally affixed to the fixed portion.

5. The shelving unit of claim 4 wherein the shelves are affixed to the removable portion of the back panel.

6. The shelving unit of claim 3 wherein at least a portion of the back panel is pivotally affixed to the tread surface.

7. The shelving unit of claim 6 wherein the shelves are attached to the pivotally affixed portion of the back panel.

8. The shelving unit of claim 1 further comprising a panel to which the shelves are attached, and wherein the panel is pivotally affixed to the tread surface.

9. The shelving unit of claim 1 wherein a transparent window extends across an arc of the tread surface adjacent the shelves.

10. The shelving unit of claim 1 wherein:

a. a tire sidewall extends inwardly from the tread surface to terminate in a sidewall edge, b. spaced opposing shelf sidewalls extend within the tire interior outside a view defined within the sidewall edge, with the shelves extending between the shelf sidewalls, whereby the view of the shelf sidewalls from the exterior of the tire is obscured by the tire sidewall.

11. The shelving unit of claim 1 wherein:

a. a tire sidewall ens inwardly from the tread surface, b. at least some of the shelves are transparent, and c. a light is situated adjacent the tire sidewall.

12. The shelving unit of claim 1 further comprising a bottom panel, wherein the tread surface has opposing sides each affixed to opposing ends of the bottom panel, with the tire interior being defined between the bottom panel and the tread surface.

13. A shelving unit comprising:

a. a tire section formed from at least a portion of a vehicle tire, the tire section including:

(1) an arcuate tread surface;

(2) a tire interior defined within the arc of the tread surface, and (3) at least one tire sidewall extending radially inwardly from the tread surface, b. one or more shelves, each shelf being mounted within the tire interior to extend at least substantially horizontally therein, wherein the shelves and shelf sidewalls are pivotally affixed with respect to the tire section, whereby they may swing into and out of the tire interior.

14. The shelving unit of claim 13 wherein:

a. the shelves are affixed between opposing shelf sidewalls, and b. the shelves and shelf sidewalls are removable as a unit from the tire interior.

15. The shelving unit of claim 13 wherein the shelves and shelf sidewalls are affixed to a back panel extending across the arc of the tread surface.

16. The shelving unit of claim 15 wherein at least a portion of the back panel is pivotally affixed to the tread surface, whereby the shelves and shelf sidewalls are pivotally affixed with respect to the tire section.

17. A shelving unit comprising:

a. at least a section of a vehicle tire, including a tread surface curving about a tire interior;

b. shelves mounted within the section of the vehicle tire within the tire interior, the shelves having lengths extending within an arc of the tread surface; and c. a bottom panel, wherein the tread surface has opposing sides each affixed to opposing ends of the bottom panel, with the tire interior being defined between the bottom panel and the tread surface.

18. The shelving unit of claim 17 further comprising a back panel extending across an arc of the tread surface, and wherein a. a tire sidewall extends inwardly from the tread surface, and b. the back panel is spaced from the tire sidewall, with the tread surface extending between the tire sidewall and the back panel.

19. The shelving unit of claim 18 wherein the shelves are affixed to the back panel.

20. The shelving unit of claim 19 wherein at least a portion of the back panel is pivotally affixed to the tread surface, and wherein the shelves thereon are pivotable out of the tire interior.

21. The shelving unit of claim 17 wherein the shelves are pivotally affixed with respect to the tread surface, and are thereby pivotable out of the tire interior.

* * * * *